US010082768B2

(12) United States Patent
Fujiya et al.

(10) Patent No.: US 10,082,768 B2
(45) Date of Patent: Sep. 25, 2018

(54) IMAGE FORMING APPARATUS

(71) Applicants: Hiromitsu Fujiya, Kanagawa (JP); Susumu Tateyama, Kanagawa (JP); Keisuke Yuasa, Kanagawa (JP); Yuusuke Kumagawa, Kanagawa (JP)

(72) Inventors: Hiromitsu Fujiya, Kanagawa (JP); Susumu Tateyama, Kanagawa (JP); Keisuke Yuasa, Kanagawa (JP); Yuusuke Kumagawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/851,766

(22) Filed: Dec. 22, 2017

(65) Prior Publication Data

US 2018/0181060 A1 Jun. 28, 2018

(30) Foreign Application Priority Data

Dec. 27, 2016 (JP) ..... 2016-253982
Nov. 28, 2017 (JP) ..... 2017-227461

(51) Int. Cl.
*G03G 21/20* (2006.01)
*G03G 15/00* (2006.01)

(52) U.S. Cl.
CPC ..... *G03G 21/206* (2013.01); *G03G 15/5062* (2013.01)

(58) Field of Classification Search
CPC ..... G03G 21/206; G03G 21/20; G03G 2221/1645; G03G 15/5062
See application file for complete search history.

(56) References Cited

U.S. PATENT DOCUMENTS

2010/0183323 A1 7/2010 Fujiya et al.
2012/0092687 A1* 4/2012 Hirai ..... B41J 3/60 358/1.9
2012/0097872 A1* 4/2012 Ito ..... G03G 15/0189 250/559.4
2012/0106987 A1* 5/2012 Furusawa ..... G03G 15/5062 399/15
2012/0315069 A1 12/2012 Ikeda et al.
2013/0243491 A1 9/2013 Nodera et al.
2014/0186080 A1 7/2014 Ikeda et al.
2014/0308058 A1 10/2014 Ikeda et al.
2015/0010338 A1 1/2015 Miyagawa et al.
(Continued)

FOREIGN PATENT DOCUMENTS

JP 5-056214 3/1993
JP 2004-078030 3/2004
(Continued)

*Primary Examiner* — Sandra Brase
(74) *Attorney, Agent, or Firm* — Oblon, McClelland, Maier & Neustadt, L.L.P.

(57) ABSTRACT

An image forming apparatus includes a conveyance path to convey a recording medium; an image forming device to form an image on the recording medium; a heating device to heat the recording medium; an image detector disposed downstream from the heating device in a direction of conveyance of the recording medium, to detect the image on the recording medium; and a protector projecting beyond the image detector toward the conveyance path. The protector is to protect the image detector; and a heat conductive holder holds the protector.

17 Claims, 5 Drawing Sheets

(56) References Cited

U.S. PATENT DOCUMENTS

| | | | |
|---|---|---|---|
| 2015/0071677 | A1 | 3/2015 | Hirasawa et al. |
| 2016/0195847 | A1 | 7/2016 | Ikeda et al. |
| 2016/0313693 | A1 | 10/2016 | Fujiya et al. |
| 2016/0342135 | A1 | 11/2016 | Fujiya et al. |

FOREIGN PATENT DOCUMENTS

| | | |
|---|---|---|
| JP | 2006-091330 | 4/2006 |
| JP | 2010-169958 | 8/2010 |
| JP | 2012-098677 | 5/2012 |
| JP | 2012-150254 | 8/2012 |
| JP | 2014-048653 | 3/2014 |
| JP | 2014-194532 | 10/2014 |
| JP | 2014-194533 | 10/2014 |
| JP | 2015-230323 | 12/2015 |
| JP | 2016-090730 | 5/2016 |
| JP | 2016-110037 | 6/2016 |
| JP | 2016-164631 | 9/2016 |

* cited by examiner

IMAGE FORMING APPARATUS

CROSS-REFERENCE TO RELATED APPLICATIONS

This patent application is based on and claims priority pursuant to 35 U.S.C. § 119(a) to Japanese Patent Application Nos. 2016-253982, filed on Dec. 27, 2016, and 2017-227461, filed on Nov. 28, 2017, in the Japan Patent Office, the entire disclosure of each of which is hereby incorporated by reference herein.

BACKGROUND

Technical Field

This disclosure relates to an image forming apparatus.

Description of the Related Art

There are image forming apparatuses that include a heating device (such as a fixing device to fix an image on a recording medium with heat) to heat the recording medium being conveyed, an image detector to detect the fixed image on the recording medium, and a protector such as a protection glass disposed between the recording medium and the image detector, to protect the image detector.

Such image forming apparatuses can further include a cooling device to cool the recording medium that has passed through the fixing device, and the image detector detects the image on the cooled recording medium.

SUMMARY

According to an embodiment of this disclosure, an image forming apparatus includes a conveyance path to convey a recording medium; an image forming device to form an image on the recording medium; a heating device to heat the recording medium; an image detector disposed downstream from the heating device in a direction of conveyance of the recording medium, to detect the image on the recording medium; and a protector projecting beyond the image detector toward the conveyance path. The protector is to protect the image detector;

and a heat conductive holder holds the protector.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
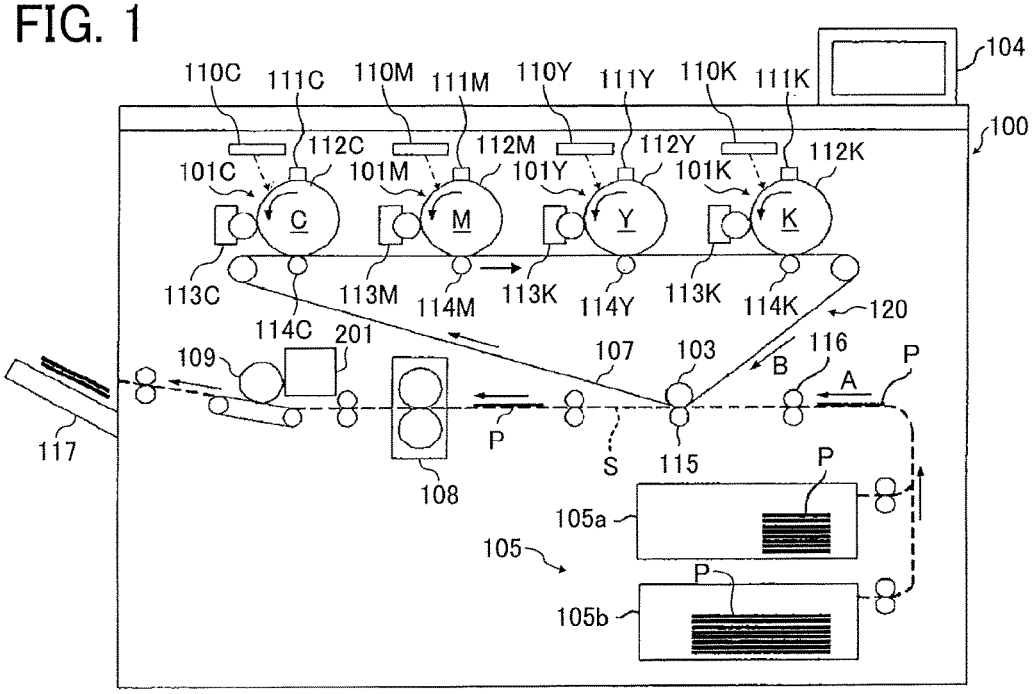
FIG. 1 is a schematic diagram of an image forming apparatus according to an embodiment.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an embodiment of this disclosure is described. As used herein, the singular forms "a", "an", and "the" are intended to include the plural forms as well, unless the context clearly indicates otherwise.

An electrophotographic printer is described below as an image forming apparatus according to one embodiment of this disclosure.

FIG. 1 is a schematic view of an image forming apparatus 100 (e.g., a printer) according to the present embodiment. Note that reference characters C, M, Y, and K attached to reference numerals in the drawings represent cyan, magenta, yellow, and black, respectively, and components given reference numerals with C, M, Y, and K are for these colors, respectively.

As illustrated in FIG. 1, the image forming apparatus 100 includes four image forming units 101 (101C, 101M, 101Y, and 101K) as toner image forming units, to form cyan, magenta, yellow, and black toner images, respectively. The four image forming units 101 (C, M, Y, and K) are similar in structure except that the color of toner used therein is different. Thus, reference characters C, M, Y, and K representing the toner colors may be omitted in the description below when color discrimination is not necessary.

As illustrated in FIG. 1, the image forming apparatus 100 includes an intermediate transfer unit 120 including an endless intermediate transfer belt 107 disposed below the four image forming units 101 (toner image forming units). The intermediate transfer belt 107 is stretched around a plurality of tension rollers to endlessly rotate. Below the intermediate transfer unit 120, a fixing device 108, serving as a heating device, is disposed, and a sheet feeder 105 including sheet feeding trays 105*a* and 105*b* to contain transfer sheets P (recording media) is disposed below the fixing device 108. The sheet feeder 105 feeds the transfer sheets P to a conveyance path S along which the transfer sheet P is conveyed. Along the conveyance path S, the transfer sheet P is conveyed in the direction indicated by arrow A, toward a registration roller pair 116.

Each of the image forming units 101 includes a drum-shaped photoconductor 112 (112C, 112M, 112Y, or 112K) serving as a latent image bearer, a charging device 111 (111C, 111M, 111Y, or 111K), a developing device 113 (113C, 113M, 113YC, or 113K), and an exposure device 110 (110C, 110M, 110Y, or 110K) serving as a latent image forming device. The charging device 111 uniformly charges the surface of the photoconductor 112 that is rotated counterclockwise in FIG. 1 by a driver. The uniformly charged surface of the photoconductor 112 is scanned for exposure with a laser beam emitted from the exposure device 110 (the latent image forming device), thereby forming an electrostatic latent image according to image data of the corresponding color, on the surface of the photoconductor 112. Then, the developing device 113 develops the electrostatic latent image on the photoconductor 112 with toner into a toner image. The respective toner images on the photoconductors 112 are sequentially transferred onto the intermediate transfer belt 107 (i.e., an intermediate transfer process).

The intermediate transfer unit 120 includes the intermediate transfer belt 107, four primary-transfer bias rollers 114 (114C, 114M, 114Y, and 114K), and a secondary-transfer backup roller 103. The intermediate transfer belt 107 endlessly rotates clockwise in FIG. 1 as indicated by arrow B in FIG. 1. The four primary-transfer bias rollers 114 (C, M, Y, and K) press against the four photoconductors 112 (C, M, Y, and K), respectively, via the intermediate transfer belt 107, and contact portions where the intermediate transfer belt 107 is nipped therebetween are called "primary transfer nips". The four primary-transfer bias rollers 114 apply transfer biases (of positive polarity, for example) opposite in polarity to the toner to a back surface (inside the loop) of the intermediate transfer belt 107.

Except the primary-transfer bias rollers 114, the plurality of rollers, around which the intermediate transfer belt 107 is looped, are electrically grounded. As the intermediate transfer belt 107 rotates and passes through the four primary transfer nips sequentially, the cyan, magenta, yellow, and black toner images are transferred from the photoconductors 112 (C, M, Y, and K) and superimposed one on another on the intermediate transfer belt 107 (primary transfer process). Thus, a four-color superimposed toner image (hereinafter "four-color toner image") is formed on the intermediate transfer belt 107.

The secondary-transfer backup roller 103 and a secondary transfer roller 115 press against each other via the intermediate transfer belt 107, and the contact portion therebetween is hereinafter referred to as a secondary transfer nip. A sheet feeding roller sends out, to the conveyance path S, the transfer sheets P contained in the sheet feeding tray 105*a* or 105*b* one by one, and the registration roller pair 116 transports the transfer sheet P to the secondary transfer nip, timed to coincide with the toner image.

The four-color toner image on the intermediate transfer belt 107 is transferred onto the transfer sheet P in the secondary transfer nip (secondary transfer process). In the secondary transfer nip, the surfaces of the intermediate transfer belt 107 and the secondary transfer roller 115 move in the same direction, and the transfer sheet P is sandwiched therebetween and transported thereby. After the transfer sheet P is released from the secondary transfer nip, the four-color toner image is fixed on the transfer sheet P with heat and pressure while the transfer sheet P passes between rollers of the fixing device 108.

After exiting the fixing device 108, the transfer sheet P is cooled by a cooling roller 109, and then discharged from the conveyance path S onto an output tray 117 located outside the housing of the image forming apparatus 100.

On an upper face of the apparatus body, a control panel 104 including a display, buttons, and keys is disposed. The image forming apparatus 100 can further includes a sheet reverse unit for duplex printing. For duplex printing, the transfer sheet P on which the toner image is fixed is conveyed to the sheet reverse unit so that the transfer sheet P is reversed and conveyed again to the registration roller pair 116. Then, a toner image is transferred from the intermediate transfer belt 107 onto a back side of the transfer sheet P. After that, similar to single-side printing, the fixing device 108 fixes the toner image on the transfer sheet P, and the transfer sheet P is discharged onto the output tray 117 outside the housing of the image forming apparatus 100.

Further, an image detecting device 201 is disposed between the fixing device 108 and the cooling roller 109. The image detecting device 201 detects an image fixed on the transfer sheet P. The image detecting device 201 includes an image sensor, such as a contact image sensor (CIS), to detect image data two-dimensionally.

In the present embodiment, the image detecting device 201 detects a position and an image density (or color tone such as hue or shade) of the fixed image on the transfer sheet P passing by the image detecting device 201. Based on the results of detection, image forming conditions are adjusted. When the image position detected by the image detecting device 201 is different from a predetermined position, for example, timing of latent image writing by the exposure device 110 or timing to start driving the registration roller pair 116 is adjusted to adjust the image position. When the image density (color tone) detected by the image detecting device 201 is different from a predetermined value, for example, a developing bias, a charging bias, and exposure (exposure power) of the exposure device 110 are adjusted to adjust the image density (color tone).

In consecutive printing of a large number of images, the image detecting device 201 detects the image position and the image density (color tone) of the image fixed on each transfer sheet, and detection results are fed back for subsequent printing. This configuration can minimize the occurrence of uneven image quality, such as the difference in quality between the first image and the last image.

The image sensor includes a board, on which a plurality of light-emitting elements and a plurality of imaging elements are lined in the direction of width of the transfer sheet P (perpendicular to the direction of conveyance of the transfer sheet P), and an image forming lens, which in the present embodiment is a Selfoc® lens array (SLA), to form an image on the imaging element.

The image sensor is susceptible to heat. For example, if the SLA is heated, a component thereof precipitates to the surface of the SLA and reacts with vapor in air to make the surface of the SLA cloudy. Then, optical performance (or imaging performance) may deteriorate. As a result, accuracy in image detection is degraded. Additionally, when the board is heated to thermally expand, the position of the imaging element may deviate from a predetermined position, resulting in degradation in image detection. Therefore, to attain preferable image detection, the temperature of the image sensor is preferably kept at or lower than 50° C.

By contrast, to detect the image fixed in the transfer sheet P with a high accuracy, there is a limitation that the distance between the image sensor and the transfer sheet P is kept at about several millimeters. That is, the image sensor is disposed close to the hot transfer sheet P heated by the fixing device. The transfer sheet P is heated to a temperature higher than 100° C. by the fixing device. When the transfer sheet P heated by the fixing device passes by a detection position by the image sensor, the image sensor is heated. In some cases in consecutive printing of a large number of images, the image sensor is heated above 50° C., and there is a risk that preferable image detection is not attained.

Between the image sensor and the transfer sheet conveyed, a protection glass to protect the image sensor is disposed. The heat from the transfer sheet is transferred via the protection glass to the image sensor, and the image sensor is heated. In view of the foregoing, in the present embodiment, the protection glass is held by a heat dissipating part to dissipate the heat from the protection glass, thereby reducing the heat transferred from the protection glass to the image sensor and suppressing temperature rise of the image sensor. This is described below with reference to drawings.

Figure 2:
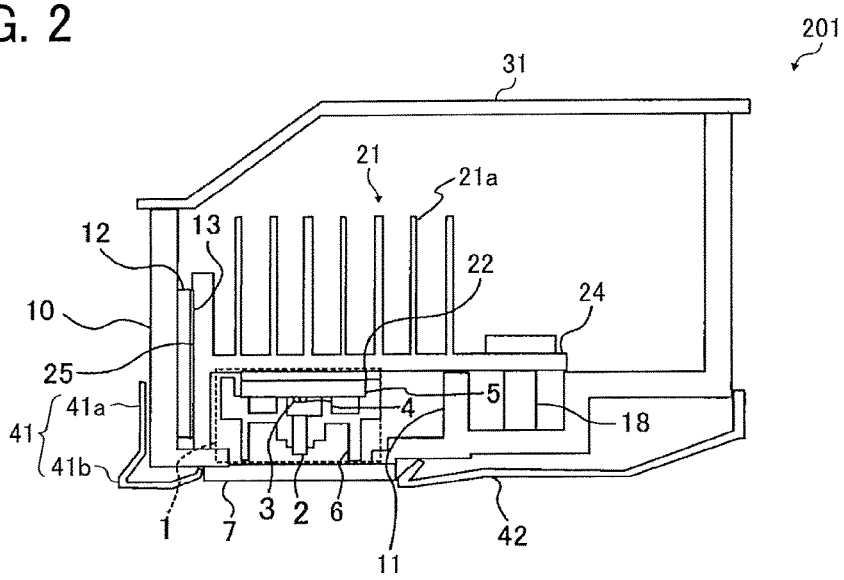
FIG. 2 is a schematic view of an image detecting device according to an embodiment.

FIG. 2 is a schematic cross-sectional view of the image detecting device 201.

As illustrated in FIG. 2, the image detecting device 201 includes image sensors 1. The image sensor 1 includes a plurality of imaging elements 3 such as photodiodes, a plurality of light-emitting elements 4 such as light emitting diodes (LEDs), and an SLA 2 (selfoc lens array) serving as an image forming lens. The plurality of imaging elements 3 and the plurality of light-emitting elements 4 are disposed on a board 5 and lined in the width direction of the transfer sheet (perpendicular to the surface of the plane on which the drawing is illustrated. The SLA 2 is held by a holder 6.

Between the image sensor 1 and the transfer sheet conveyed, a transmissive protection glass 7, serving as a protector to protect the image sensor 1, is disposed. That is, the protection glass 7 projects toward the conveyance path S beyond the image sensor 1 (beyond the lower end thereof in FIG. 2). The protection glass 7 is supported by a heat dissipating part 10 (i.e., a heat dissipating holder), and the image sensors 1 are housed in the heat dissipating part 10. The heat dissipating part 10 includes sensor mounts 11 to support the image sensors 1. The heat dissipating part 10 is shaped like a box and is open on the upper side in FIG. 2, and a cover 31 is attached to the upper side.

The heat dissipating part 10 is a heat conductive component, which is defined as a component having a thermal conductivity equal or greater than 60 W/m·K. In the present embodiment, the thermal conductivity of the heat conductive component is preferably equal to or greater than 200 W/m·K and, more preferably, equal to or greater than 400 W/m·K. In the present embodiment, the heat dissipating part 10 is made of aluminum having a thermal conductivity equal to or greater than 200 W/m·K.

When the transfer sheet P passes by the image detection position of the image sensor 1, the heat of the transfer sheet P heated by the fixing device 108 is initially transferred to the protection glass 7. From the protection glass 7, the heat is transferred to the heat dissipating part 10 that is the heat conductive holder supporting the protection glass 7. Thus, temperature rise of the protection glass 7 is suppressed. The heat dissipating part 10 is shaped like a box having four side walls extending in the direction perpendicular to the surface of the transfer sheet P. The ambient temperature in a lower section in FIG. 2 is high since the transfer sheet P heated by the fixing device 108 passes therethrough. By contrast, the ambient temperature in an upper section in FIG. 2 is sufficiently low compared with the lower section. Since the heat dissipating part 10 is constructed of a heat conductive material as described above, the heat transferred from the protection glass 7 is promptly transferred to the upper section in FIG. 2, in which the ambient temperature is lower, and dissipated. With this structure, even in consecutive printing of a large number of images, the heat of the protection glass 7 heated by the transfer sheet P can be preferably transferred to the heat dissipating part 10, thereby suppressing the temperature rise of the protection glass 7. Accordingly, heat transfer from the protection glass 7 to the image sensor 1 can be suppressed, thereby inhibiting the temperature rise of the image sensor 1. This can inhibit thermal deformation such as clouding of the SLA of the image sensor 1 and thermal expansion of the board 5 holding the imaging elements 3 and the light-emitting elements 4. Thus, preferable image detection can be attained.

The heat dissipating part 10 is provided with sheet guides 41 and 42 to guide the transfer sheet P being conveyed. Guide faces of the sheet guides 41 and 42 to guide the transfer sheet P project beyond the protection glass 7 toward the conveyance path S, to guide the transfer sheet P not to contact the protection glass 7. This structure inhibits the protection glass 7 from slidingly contacting the transfer sheet P being conveyed and stains on the transfer sheet P from adhering to the protection glass 7. Thus, damage of the protection glass 7 can be inhibited. Accordingly, the image sensor 1 can detect the image fixed on the transfer sheet P preferably for a long time.

Since the transfer sheet P is guided not to contact the protection glass 7, direct heat transfer from the transfer sheet P to the protection glass 7 is inhibited, thereby inhibiting the temperature rise of the protection glass 7.

Disposing the sheet guides 41 and 42 respectively upstream and downstream from the protection glass 7 in the direction of conveyance of the transfer sheet P is advantageous in inhibiting both of the transfer sheet P advancing to the image detection position and the transfer sheet P departing from the image detection position from contacting the protection glass 7.

In the present embodiment, the sheet guides 41 and 42 are made of Steel Special Use Stainless (SUS) according to Japan Industrial Standard (JIS). When the sheet guides 41 and 42 are made of SUS, damages to the surfaces thereof by the image fixed on the transfer sheet P are inhibited. Since the sheet guides 41 and 42 contact the transfer sheet P, the temperature of the sheet guides 41 and 42 rises due to direct heat transfer from the transfer sheet P. From the portion of the sheet guides 41 and 42 in contact with the heat dissipating part 10, the heat is transferred to the heat dissipating part 10, and temperature rises around the portion of the heat dissipating part 10 holding the protection glass 7. As a result, the amount of heat transferred from the protection glass 7 to the heat dissipating part 10 decreases, and inhibition of temperature rise of the protection glass 7 may become insufficient. Therefore, the sheet guides 41 and 42 are preferably contactless with the heat dissipating part 10 except in the portions attached to the heat dissipating part 10. For example, the sheet guide 41 includes an attached portion 41*a* attached to the heat dissipating part 10 and a contactless portion 41*b* contactless with the heat dissipating part 10. This structure inhibit the heat transfer from the sheet guides 41 and 42 to the heat dissipating part 10 and reduction in the amount of heat transferred from the protection glass 7 to the heat dissipating part 10.

When the sheet guides 41 and 42 are made of a material having a low thermal conductivity or are attached to the heat dissipating part 10 via a component having a low thermal conductivity, transition of heat from the sheet guides 41 and 42 to the heat dissipating part 10 can be inhibited.

In the present embodiment, the sheet guides 41 and 42 are attached to the side walls at both ends in the width direction of the transfer sheet P. In the heat dissipating part 10, guide attachment portions to which the sheet guides 41 and 42 are attached are away from a protector holding portion to hold the protection glass 7. This structure can inhibit temperature rise of an area adjacent to the protector holding portion of the heat dissipating part 10 holding the protection glass 7, due to the heat transferred from the sheet guides 41 and 42.

Alternatively, the sheet guides 41 and 42 may be attached to other component than the heat dissipating part 10 to inhibit the transfer of heat from the sheet guides 41 and 42 to the heat dissipating part 10. In such a structure, however, the accuracy in relative positions between the sheet guides 41 and 42 and the protection glass 7 decreases due to accumulation of tolerance of dimensions or assembling of components. Then, the sheet guides 41 and 42 may fail to guide the transfer sheet not to contact the protection glass 7. Therefore, the sheet guides 41 and 42 are preferably attached to the heat dissipating part 10.

Inside the heat dissipating part 10, a heat dissipating assist 21 to assist the heat dissipating part 10 in dissipating heat is disposed. Similar to the heat dissipating part 10, the heat dissipating assist 21 is made of aluminum in the present embodiment. The heat dissipating assist 21 includes heat receiving parts 25 on the left in FIG. 2. The heat receiving part 25 are thermally coupled, via first heat conductive sheets 12, to the heat dissipating part 10. On the right in FIG. 2, the heat dissipating assist 21 includes attached portions 24 screwed to attachment portions 18 of the heat dissipating part 10. The heat dissipating assist 21 includes a plurality of fins, serving as heat dissipating portions 21*a*, extending in the width direction of the transfer sheet P (perpendicular to the plane on which the drawing is illustrated). A portion of the heat of the heat dissipating part 10 is transferred, via the first heat conductive sheets 12, to the heat dissipating assist 21 and dissipated from the heat dissipating portions 21*a*. This structure is advantageous, over a structure in which heat is dissipated from only the heat dissipating part 10, in improving efficiency in dissipating heat and inhibiting temperature rise of the heat dissipating part 10. As a result, heat is preferably transferred from the protection glass 7 to the heat dissipating part 10, and the temperature rise of the protection glass 7 can be suppressed. Accordingly, heat transfer from the protection glass 7 to the image sensor 1 can be suppressed, thereby inhibiting the temperature rise of the image sensor 1.

The heat dissipating assist 21 is further thermally coupled, via second heat conductive sheets 22, to the boards 5 of the image sensors 1. The board 5 of the image sensor 1 includes image processing chips 5*a* (illustrated in FIG. 3) to process the image captured by the imaging elements 3, and the image processing chips 5*a* generate heat. Since the light-emitting elements 4, such as LEDs, held by the board 5 also generate heat, there is a risk that the board 5 is heated to result in thermal deformation (e.g., thermal expansion). If the board 5 thermally deforms, positions of the imaging elements 3 held on the board 5 may shift from the predetermined positions, and the position of focus may change. As a result, the image captured by the imaging elements 3 may be out of focus, degrading the accuracy in image detection. When the heat of the board 5 is transferred to the SLA 2, the SLA 2 may be heated and the surface thereof may become cloudy.

In the present embodiment, the heat of the boards 5 is transferred via the second heat conductive sheets 22 to the heat dissipating assist 21. The heat transferred from the board 5 to the heat dissipating assist 21 is dissipated by the heat dissipating portions 21*a*. Thus, temperature rise and thermal deformation of the board 5 is inhibited, and degradation of accuracy in image detection is suppressed. Further, the SLA 2 is inhibited from being heated by the board 5, and clouding of the surface of the SLA 2 is inhibited.

Since the heat dissipating assist 21 is made of aluminum and conductive, the second heat conductive sheet 22 is preferably insulative. When the second heat conductive sheet 22 are insulative, the current flowing in the boards 5 is inhibited from flowing via the second heat conductive sheets 22 to the heat dissipating assist 21.

Figure 3:
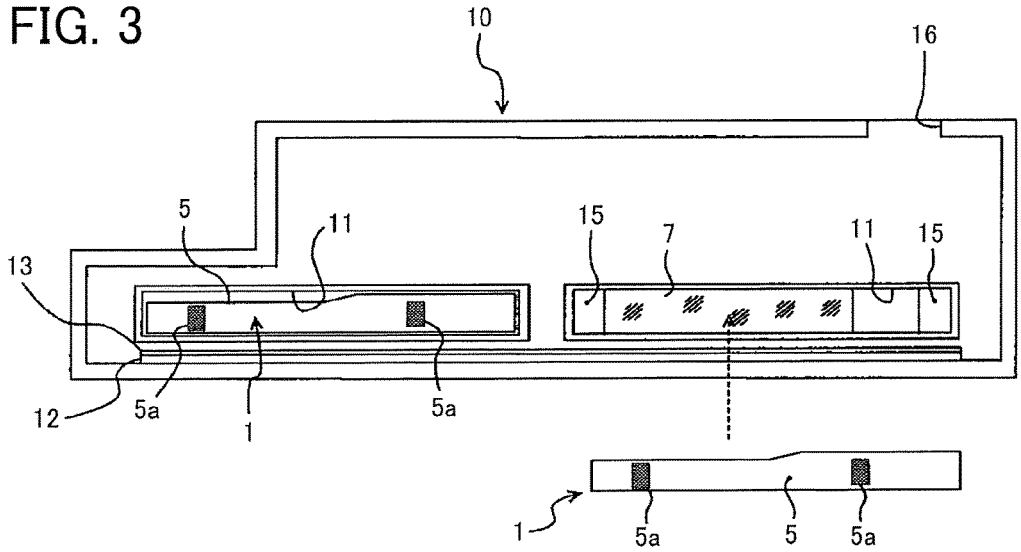
FIG. 3 is a view of a heat dissipating part to which image sensors are attached, according to an embodiment.

Referring to FIG. 3, descriptions are given below of attachment of the image sensor 1 to the heat dissipating part 10.

As illustrated in FIG. 3, the heat dissipating part 10 includes two sensor mounts 11 shaped like boxes to hold the image sensors 1 are disposed side by side in the width direction of the transfer sheet P (the lateral direction in FIG. 3). At both ends of the sensor mount 11 in the width direction of the transfer sheet P, positioning portions 15 are disposed to determine the position of the image sensor 1 in the direction perpendicular to the surface of the transfer sheet P on which an image is formed (perpendicular to the surface of the paper on which FIG. 3 is drawn). The two image sensors 1 are fitted in the sensor mounts 11, respectively, and lined in the width direction of the transfer sheet P. Thus, the image sensors 1 are held ty the heat dissipating part 10.

The image processing chips 5*a* to process the image captured by the imaging elements 3 are mounted at two positions in the width direction of the transfer sheet P on a back side of the board 5 of the image sensor 1 opposite the face on which the imaging elements 3 and the light-emitting elements 4 are mounted.

Figure 4:
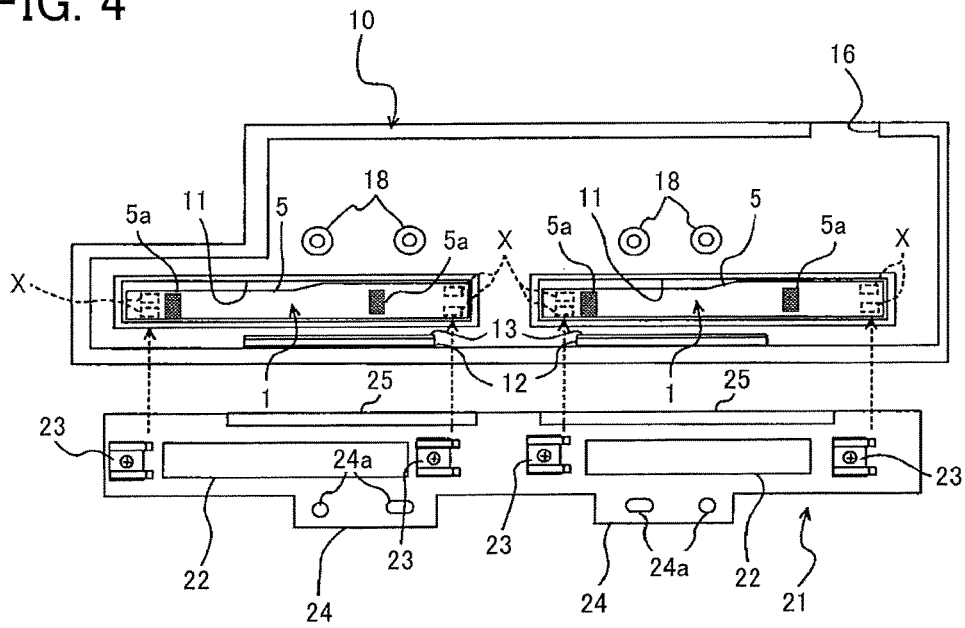
FIG. 4 is a schematic view of a heat dissipating assist and the heat dissipating part holding the image sensors illustrated in FIG. 3.

FIG. 4 is a schematic view of the heat dissipating assist 21 and the heat dissipating part 10 holding the image sensors 1.

As illustrated in FIG. 4, flat springs 23 are disposed at four positions on a face of the heat dissipating assist 21 opposing the boards 5 of the image sensors 1. On the face of the heat dissipating assist 21 opposing the boards 5 of the image sensors 1, the flat springs 23 are disposed to contact the end portions (indicated with reference X) of the boards 5 in the width direction of the transfer sheet P (the lateral direction in FIG. 4). The second heat conductive sheets 22 are attached to the face of the heat dissipating assist 21 opposing the boards 5. In FIG. 4, the second heat conductive sheets 22 extend to cover entirely the back faces of the boards 5. Alternatively, the second heat conductive sheets 22 can be provided in tight contact with only the image processing chips 5*a*, which generate a relative large amount of heat, to transfer the heat from the image processing chips 5*a* to the heat dissipating assist 21.

On the side wall of the heat dissipating part 10 on the bottom in FIG. 4, the first heat conductive sheets 12 are attached. The first heat conductive sheets 12 are elastic bodies such as acrylic rubber and silicone rubber. Compressed by the heat dissipating assist 21, the first heat conductive sheets 12 tightly contact heat receiving parts 25 of the heat dissipating assist 21 and transfer the heat of the heat dissipating part 10 to the heat dissipating assist 21. In attaching the heat dissipating assist 21 to the heat dissipating part 10, the heat receiving parts 25 are slid on the first heat conductive sheets 12 while squashing to flatten the first heat conductive sheets 12. The first heat conductive sheets 12, however, are elastic bodies such as acrylic rubber and silicone rubber and lower in sliding performance. Accordingly, there has been a risk that the heat receiving parts 25 do not slide on the first heat conductive sheets 12 and the first heat conductive sheets 12 peel off the heat dissipating part 10.

Therefore, in the present embodiment, slide assist sheets 13 are attached to the surfaces of the first heat conductive sheets 12. A friction coefficient of the slide assist sheets 13 with the heat receiving parts 25 is lower than that of the first heat conductive sheets 12 with the heat receiving parts 25. In the present embodiment, polyethylene terephthalate (PET) film is used. This structure inhibits the first heat conductive sheets 12 from peeling off the heat dissipating part 10 when the heat dissipating assist 21 is attached to the heat dissipating part 10.

Screws are inserted into through holes 24*a* of the attached portions 24 of the heat dissipating assist 21 and screwed into screw holes of the attachment portions 18 of the heat dissipating part 10. Then, the heat dissipating assist 21 is attached to the heat dissipating part 10. As the heat dissipating assist 21 is attached to the heat dissipating part 10, the second heat conductive sheets 22 are compressed to tightly contact the back faces of the boards 5.

Note that the heat dissipating part 10 has a communication hole 16 (illustrated in FIG. 4) to communicate with a duct to introduce air into the heat dissipating part 10.

Figure 5:
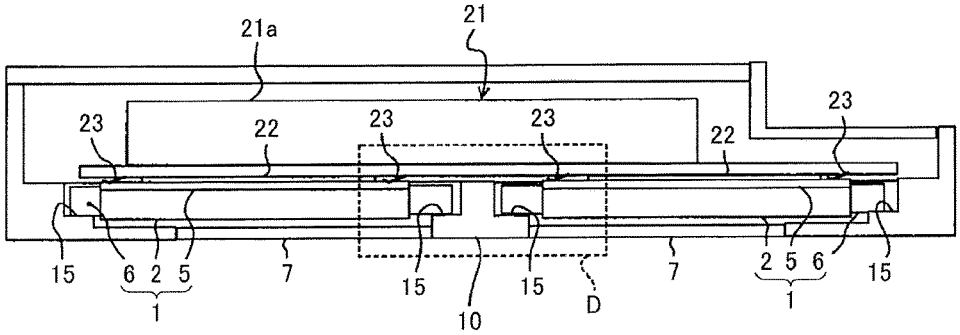
FIG. 5 is a view of the heat dissipating part for understanding of positioning of the image sensors.
Figure 6:
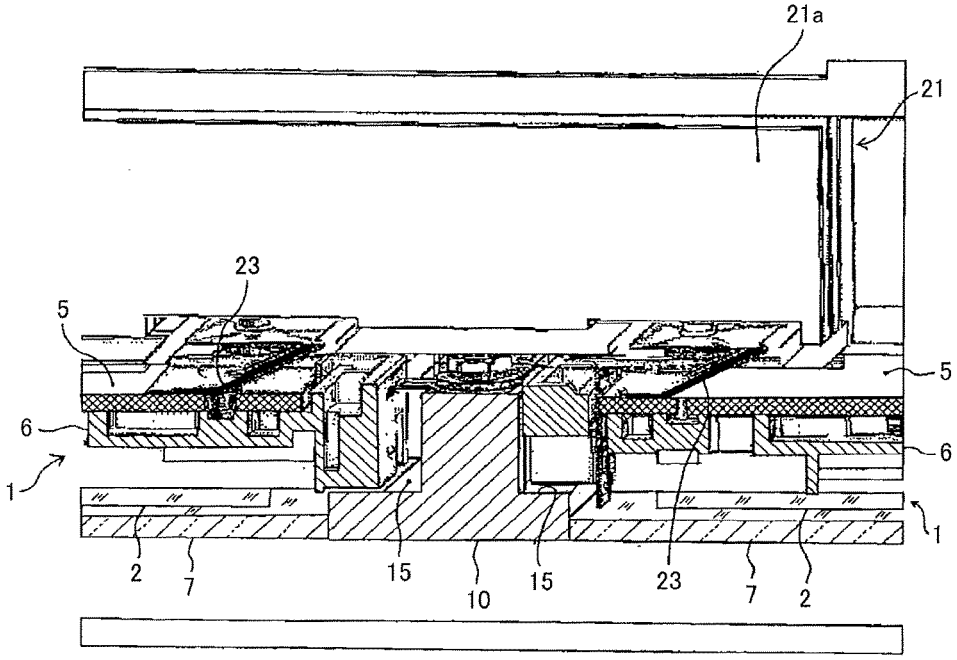
FIG. 6 is an enlarged cross-sectional view of an area indicated by broken lines in FIG. 5.

FIG. 5 is a view of the heat dissipating part 10 for understanding of positioning of the image sensors 1. FIG. 6 is an enlarged cross-sectional view of an area D indicated by broken lines in FIG. 5.

As the heat dissipating assist 21 is attached to the heat dissipating part 10, the flat springs 23 press the both ends of the boards 5 in the width direction of the transfer sheet P, toward the protection glass 7. Then, the holder 6 of the image sensor 1 contacts the positioning portions 15 of the heat dissipating part 10, and the position of the image sensor 1 is determined in the direction perpendicular to the surface of the transfer sheet P on which an image is formed. With this structure, the focus of the imaging elements 3 is adjusted to the area in which the transfer sheet P is conveyed, and the image on the transfer sheet P can be detected accurately.

If the heat released from the heat dissipating portions 21*a* of the heat dissipating assist 21 remains inside the heat dissipating part 10, the temperature of the heat dissipating part 10 rises, and the efficiency of heat dissipating of the protection glass 7 decreases. Simultaneously, the efficiency of heat dissipating of the heat dissipating assist 21 decreases. Accordingly, introducing air into the heat dissipating part 10 is preferable to vent the hot air from the heat dissipating part 10 and cool the heat dissipating assist 21 with the introduced air.

Figure 7:
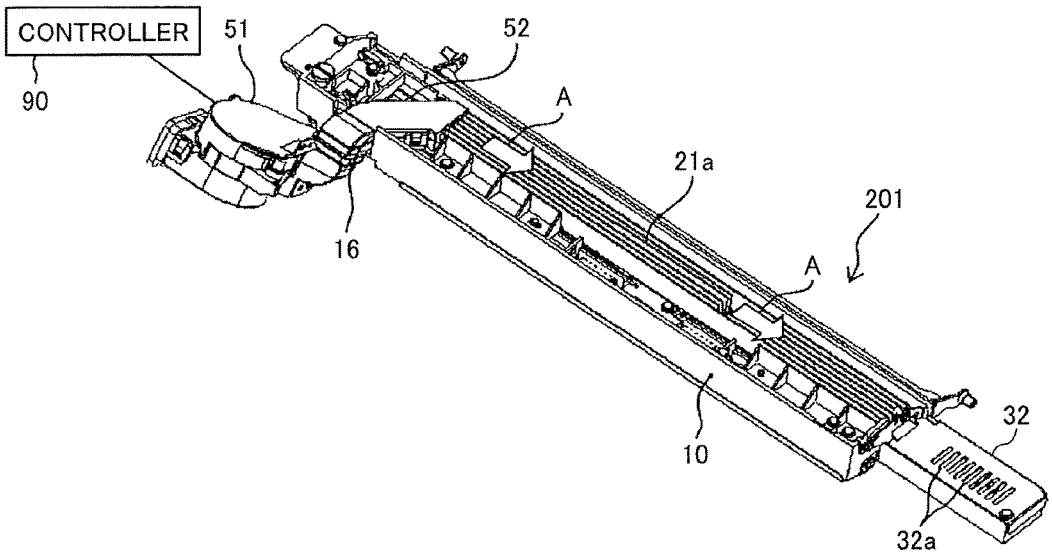
FIG. 7 is a perspective view of the image detecting device illustrated in FIG. 2.

FIG. 7 is a perspective view of the image detecting device 201.

As illustrated in FIG. 7, at a first end (on the left in FIG. 7) of the heat dissipating part 10 in the width direction of the transfer sheet P, the communication hole 16 is disposed to introduce a duct 52 into the heat dissipating part 10. The duct 52 is inserted into the communication hole 16 and disposed such that a blow-off port of the duct 52 is opposite the heat dissipating portions 21*a* of the heat dissipating part 10. At an air intake of the duct 52, an air blowing port of the sirocco fan 51 is attached. To a second end (lower right in FIG. 7) of the heat dissipating part 10 in the width direction of the transfer sheet P, a ventilation lid 32 having a plurality of vents 32*a* is attached.

The air taken by the sirocco fan 51 flows through the duct 52 into the heat dissipating part 10 and blows out the blow-off port of the duct 52. As indicated by arrow A in FIG. 7, the air flows toward the second end (lower right in FIG. 7) in the width direction of the transfer sheet P and cools the heat dissipating portions 21*a* of the heat dissipating assist 21. The air heated with the heat from the heat dissipating portions 21*a* is discharged from the plurality of vents 32*a* of the ventilation lid 32 at the second end of the heat dissipating part 10 in the width direction of the transfer sheet P. This structure can suppress temperature rise of the heat dissipating assist 21, and the heat of the boards 5 and the heat dissipating part 10 is preferably dissipated.

Since the air inside the image forming apparatus 100 is warmer than external air due to heat generated by components of the image forming apparatus 100, the sirocco fan 51 preferably takes in external air. Accordingly, the housing of the image forming apparatus 100 preferably has an air intake coupled to the air intake of the sirocco fan 51 so that the sirocco fan 51 takes in the external air.

For example, when the transfer sheet P is a thick sheet or an image having a high image area rate is formed, the amount of heat required for image fixing increases. Accordingly, the temperature of the fixing device 108 is raised. Consequently, the temperature of the transfer sheet P discharged from the fixing device 108 is higher, and the temperature of the image sensors 1 easily rises. Accordingly, the amount of air introduced into the heat dissipating part 10 is preferably increases in such cases. By contrast, in printing on only one sheet, the image sensors 1 are not heated to or higher than 50° C. even if the heat dissipating assist 21 is not cooled with air. Accordingly, the driving of the sirocco fan 51 is preferably stopped in such a case.

Therefore, in the present embodiment, the sirocco fan 51 is connected to a controller 90, and the controller 90 controls the amount of air introduced into the heat dissipating part 10. Then, the controller 90 can control the sirocco fan 51 to adjust the amount of air introduced into the heat dissipating part 10 based on the thickness of the transfer sheet P, the image area rate, or the number of transfer sheets printed. Such control is advantageous in suppressing the temperature rise of the image sensors 1 and reducing noise such as swish generated by the sirocco fan 51 and power supplied to the sirocco fan 51.

In the present embodiment, the heat dissipating assist 21 includes the heat dissipating portions 21*a*, such as fins, to be air-cooled to cool the heat dissipating assist 21. Alternatively, the heat dissipating assist 21 can be cooled with a liquid-cooling device. Yet alternatively, the heat dissipating assist 21 can be omitted and the heat dissipating part 10 is cooled with the liquid-cooling device, to enhance the efficiency in heat dissipating of the heat dissipating part 10.

Figure 8:
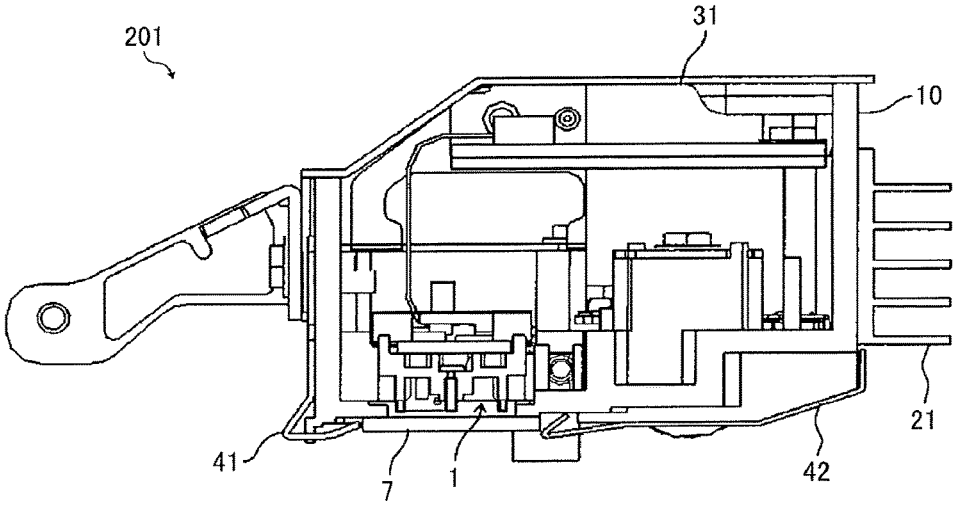
FIG. 8 is a schematic view of an image detecting device according to an embodiment, in which the heat dissipating assist is attached to an outer face of the heat dissipating part.
Figure 9:
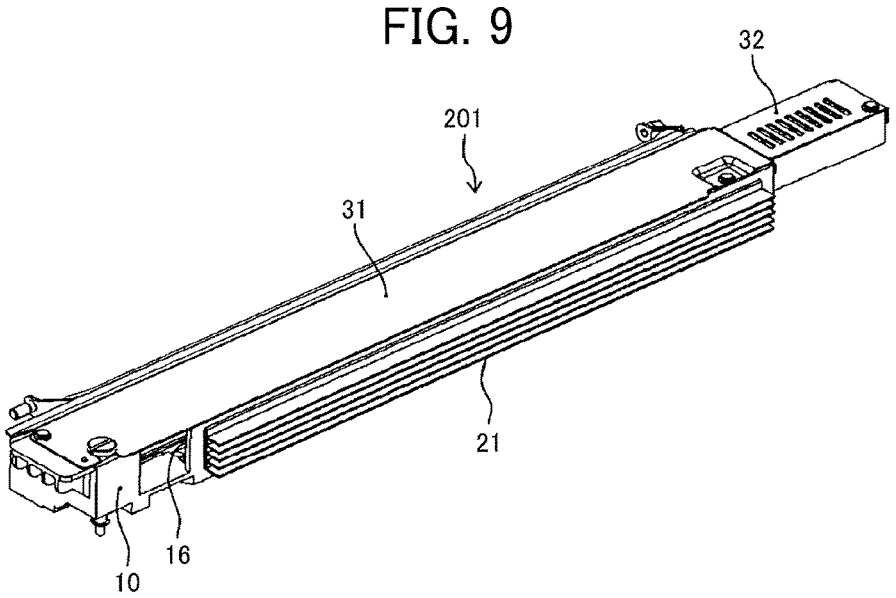
FIG. 9 is a schematic perspective view of the image detecting device illustrated in FIG. 8.

FIG. 8 is a schematic view of an image detecting device 201 in which the heat dissipating assist 21 is attached to an outer face of the heat dissipating part 10. FIG. 9 is a schematic perspective view of the image detecting device 201 illustrated in FIG. 8.

As illustrated in FIGS. 8 and 9, the heat dissipating assist 21 can be attached to the outer face of the heat dissipating part 10. Such a structure can similarly transfer the heat of the heat dissipating part 10 to the heat dissipating assist 21 and dissipate the heat from the heat dissipating portions 21*a*. Thus, temperature rise of the heat dissipating part 10 is suppressed, and the heat is preferably transferred from the protection glass 7 to the heat dissipating part 10. In this structure, cooling the heat dissipating portions 21*a* with air is preferable.

The above-described structure inhibits heat transfer from the sheet guides 41 and 42 to the heat dissipating part 10 to suppress decreases in the amount of heat transferred from the protection glass 7 to the heat dissipating part 10, thereby suppressing the temperature rise of the protection glass 7. However, depending on the configuration of the apparatus, actively releasing heat from the sheet guides 41 and 42 to the heat dissipating part 10 to actively absorb heat from the transfer sheets with the sheet guides 41 and 42 is more advantageous in suppressing heat transfer from the transfer sheets to the protection glass 7 and accordingly in suppressing the temperature rise of the protection glass 7.

Figure 10:
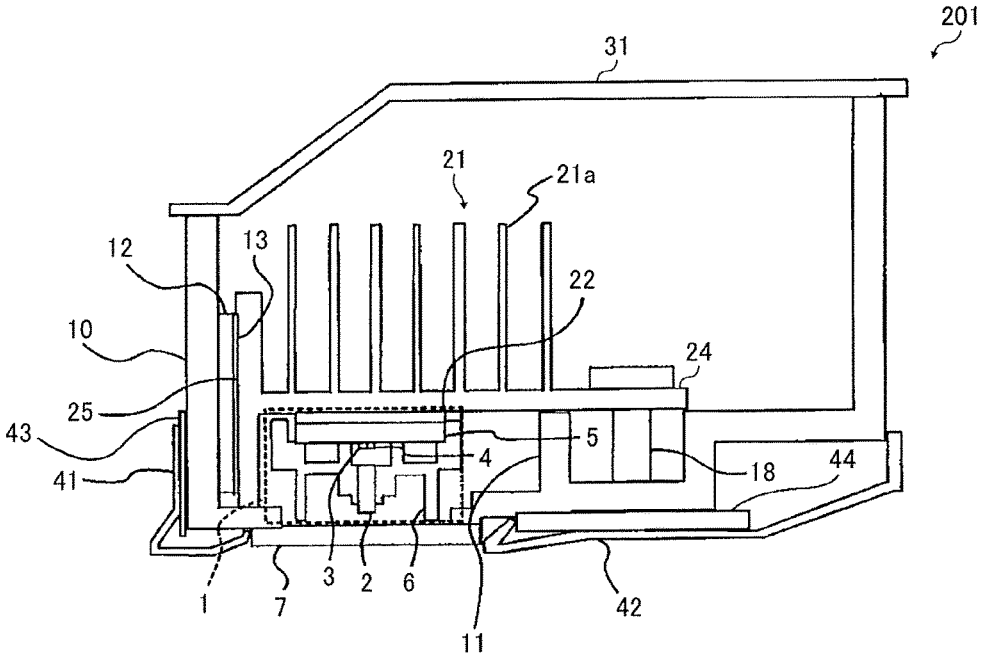
FIG. 10 is a schematic view of an image detecting device according to an embodiment, in which a heat conductive sheet is disposed between a guide and the heat dissipating part.

FIG. 10 is a schematic view of an image detecting device in which a heat conductive sheet is disposed between the sheet guides 41 and 42 and the heat dissipating part 10, to actively release heat of the sheet guides 41 and 42 to the heat dissipating part 10.

As illustrated in FIG. 10, the image detecting device 201 illustrated in FIG. 10 includes a third heat conductive sheet 43 and a fourth heat conductive sheet 44. The third heat conductive sheet 43 is disposed in tight contact with the sheet guide 41 and the heat dissipating part 10 to transfer the heat from the sheet guide 41 to the heat dissipating part 10. The fourth heat conductive sheet 44 is disposed in tight contact with the sheet guide 42 and the heat dissipating part 10 to transfer the heat from the sheet guide 42 to the heat dissipating part 10. With this structure, a portion of the heat of the sheet guide 41 is transferred, via the third heat conductive sheet 43, to the heat dissipating part 10 and dissipated from the heat dissipating part 10. Similarly, a portion of the heat of the sheet guide 42 is transferred, via the fourth heat conductive sheet 44, to the heat dissipating part 10 and dissipated from the heat dissipating part 10. Further, a portion of the heat transferred from the sheet guides 41 and 42 to the heat dissipating part 10 is transferred, via the first heat conductive sheets 12, to the heat dissipating assist 21 and dissipated from the heat dissipating portions 21*a*. As a result, temperature rise of the sheet guides 41 and 42 is suppressed so that the sheet guides 41 and 42 can preferably absorb heat of the transfer sheets. Since the transfer sheets are cooled, the amount of heat transferred from the transfer sheets to the protection glass 7 is reduced. Accordingly, the temperature rise of the protection glass 7 is inhibited, and heat transfer from the protection glass 7 to the image sensor 1 is suppressed, thereby inhibiting the temperature rise of the image sensor 1.

Note that, although the fixing device is described as the heating device in the above-described embodiment, the heating device is not limited thereto but can be any device to heat the recording medium. For example, an inkjet recording device serving as the image forming apparatus includes a heating device to heat the recording medium to dry the ink applied onto the recording medium.

The structures described above are just examples, and various aspects of the present disclosure can attain, for example, the following effects, respectively.

Aspect 1

An image forming apparatus includes a conveyance path to convey a recording medium; an image forming device (e.g., the four image forming units 101 and the intermediate transfer unit 120, and the like) to form an image on the recording medium; a heating device (e.g., the fixing device 108) to heat the recording medium; an image detector (e.g., the image sensor 1) disposed downstream from the heating device in the direction of conveyance of the recording medium, to detect an image on the recording medium that has passed through the heating device; and a protector (e.g., the protection glass 7) projecting beyond a lower end of the image detector toward the conveyance path, to protect the image detector. Further, the protector is held by a heat conductive holder (e.g., the heat dissipating part 10).

As described above, the structure in which the protector (e.g., the protection glass 7) disposed between the image detector (e.g., the image sensor 1) and the recording medium (e.g., the transfer sheet P) is held by the heat conductive holder (e.g., the heat dissipating part 10) attains the following effect. When the recording medium heated by the fixing device 108 passes by the image detection position of the image detector, the heat transferred from the recording medium to the protector is dissipated with the heat conductive holder. This structure can inhibit the image detector from being heated by the heat of the recording medium and suppress the temperature rise of the image detector without providing a cooling device to cool the recording medium. Thus, the apparatus can be kept compact.

Aspect 2

The image forming apparatus according to Aspect 1 further includes a heat dissipating assist (e.g., the heat dissipating assist 21) to assist the heat conductive holder (e.g., the heat dissipating part 10) in dissipating the heat.

In this structure, as described above, the heat of the protector (e.g., the protection glass 7) can be dissipated with the heat conductive holder (e.g., the heat dissipating part 10) and the heat dissipating assist 21. Accordingly, the efficiency of heat dissipating can improve compared with dissipating the heat of the protector with the heat conductive holder. Thus, temperature rise of the heat conductive holder is suppressed, and the heat is preferably transferred from the protector (e.g., the protection glass 7) to the heat conductive holder. This structure can inhibit the image detector from being heated by the heat of the recording medium and suppress the temperature rise of the image detector.

Aspect 3

In Aspect 2, the heat dissipating assist 21 receives heat from the board 5 of the image detector (e.g., the image sensor 1) and dissipates the heat.

As described above, this structure can suppress the temperature rise of the board 5 of the image detector (e.g., the image sensor 1) due to the heat generated by the board 5. Accordingly, thermal expansion of the board 5 is inhibited. This structure can inhibit the inconvenience in which the position of the imaging element on the board 5 deviates from the predetermined position to cause out-of-focus of the image fixed on the recording medium (transfer sheet) in capturing the image with the imaging element. Further, temperature rise of the image forming lens (e.g., the SLA 2) of the image detector due to the heat of the board can be inhibited. Accordingly, this structure can prevent the component of the image forming lens from precipitates to the surface of the image forming lens, reacting with vapor, and making the surface of the lens cloudy. Accordingly, preferable image detection is attained.

Aspect 4

In Aspect 3, the heat dissipating assist 21 includes a pressing member (e.g., the flat spring 23) to press the image detector (e.g., the image sensor 1) to the positioning portion 15 to determine the position of the image detector.

According to this aspect, the heat dissipating assist 21 is usable as the mechanism to press the image detector (e.g., the image sensor 1) to the positioning portion 15 to determine the position of the image detector. Accordingly, compared with a structure including the heat dissipating assist 21 and the mechanism to press separately, the number of components is reduced, and the cost of the apparatus is reduced.

Aspect 5

The image forming apparatus according to Aspect 3 or 4 further includes a board heat conductor (e.g., the second heat conductive sheet 22) disposed in tight contact with the board 5 of the image detector (e.g., the image sensor 1) and the heat dissipating assist 21 to transfer the heat of the board 5 to the heat dissipating assist 21.

The board 5 and the heat dissipating assist 21 are rigid and the surfaces thereof are not fully smooth. Accordingly, the entire surface of the board 5 does not tightly contact the heat dissipating assist 21, but a gap (a layer of air) is created therebetween. Then, effective heat transfer from the board 5 to the heat dissipating assist 21 may be inhibited.

In view of the foregoing, according to Aspect 5, the board heat conductor (e.g., the second heat conductive sheet 22) tightly contacts both of the board 5 of the image detector and the heat dissipating assist 21. Through the board heat conductor, heat is effectively transferred from the board 5 to the heat dissipating assist 21. Accordingly, the temperature rise of the board is preferably inhibited.

Aspect 6

In Aspect 5, the board heat conductor (e.g., the second heat conductive sheet 22) is insulative.

As described above, this aspect can inhibit the current flowing in the board 5 from flowing via the board heat conductor (e.g., the second heat conductive sheet 22) to the heat dissipating assist 21.

Aspect 7

The image forming apparatus according to any one of Aspects 2 to 6 further includes a holder heat conductor (e.g., the first heat conductive sheet 12) disposed in tight contact with the heat conductive holder (e.g., the heat dissipating part 10) and the heat dissipating assist 21 to transfer the heat of the heat conductive holder (e.g., the heat dissipating part 10) to the heat dissipating assist 21.

The heat conductive holder (e.g., the heat dissipating part 10) and the heat dissipating assist 21 are rigid and the surfaces thereof are not fully smooth. Accordingly, the heat conductive holder does not tightly contact the heat dissipating assist 21, but a gap (a layer of air) is created therebetween. Then, effective heat transfer from the heat conductive holder to the heat dissipating assist 21 may be inhibited.

In view of the foregoing, according to Aspect 7, the holder heat conductor (e.g., the first heat conductive sheet 12) tightly contacts both of the heat conductive holder (e.g., the heat dissipating part 10) and the heat dissipating assist 21. Through the holder heat conductor, heat is effectively transferred from the holder heat conductor to the heat dissipating assist 21. Thus, temperature rise of the heat conductive holder is suppressed, and the heat is preferably transferred from the protector (e.g., the protection glass 7) to the heat dissipating part 10.

Aspect 8

In Aspect 7, the holder heat conductor (e.g., the first heat conductive sheet 12) is attached to one (the heat dissipating part 10 in the above-described embodiment) of the heat dissipating assist 21 and the heat conductive holder (e.g., the heat dissipating part 10), and the holder heat conductor includes a slide assist sheet (e.g., the slide assist sheet 13) disposed in a contact portion to contact the other (a contact counterpart) of the heat dissipating assist 21 and the heat conductive holder. A friction coefficient between the slide assist sheet and the contact counterpart is lower than the friction coefficient between the holder heat conductor and the contact counterpart.

According to this aspect, when the contact counterpart (the heat dissipating assist 21 in the above-described embodiment) is attached to the heat conductive holder (the heat dissipating part 10) while being slid on the holder heat conductor (e.g., the first heat conductive sheet 12), the contact counterpart can smoothly slide on the slide assist sheet (i.e., the surface of the holder heat conductor). Accordingly, the holder heat conductor is prevented from peeling off the one of the heat dissipating assist 21 and the heat conductive holder to which the holder heat conductor is attached.

Aspect 9

The image forming apparatus according to any one of Aspects 2 to 8 further includes a cooling device (e.g., the sirocco fan 51 and the duct 52) to cool the heat dissipating assist 21.

As described above with reference to FIG. 7, this structure can suppress temperature rise of the heat dissipating assist 21, and the heat transferred from the heat dissipating part 10 is preferably dissipated.

Aspect 10

The image forming apparatus according to Aspect 9 further includes a controller (e.g., the controller 90) to control the cooling device (e.g., the sirocco fan 51 and the duct 52).

As described above with reference to FIG. 7, according to this aspect, the controller can control the cooling device based on the temperature of the transfer sheet transported to the image detection position where the image detector detects the image. Accordingly, the temperature rise of the image detector is preferably inhibited, and cooling can be limited to bare minimum, saving the energy consumption of the apparatus.

Aspect 11

The image forming apparatus according to Aspects 1 to 10 further includes a sheet guide (e.g., the sheet guides 41 and 42) to guide the recording medium (e.g., the transfer sheet P) passing by the image detection position of the image detector (e.g., the image sensor 1) not to contact the protector (e.g., the protection glass 7), and the sheet guide is attached to the heat conductive holder.

As described above, according to this aspect, the sheet guide is attached to the heat conductive holder (e.g., the heat dissipating part 10) to hold the protector, thereby minimizing the accumulation of component tolerance. Accordingly, deviations in the relative positions between the protector and the sheet guide can be inhibited. Thus, the sheet guide can guide the recording medium not to contact the protector, and contamination and temperature rise of the protector can be inhibited.

Aspect 12

In Aspect 11, the sheet guide (e.g., the sheet guides 41 and 42) is contactless with the heat conductive holder (e.g., the heat dissipating part 10) except in the portions attached to the heat conductive holder.

According to this aspect, although the sheet guides 41 and 42 are heated when the transfer sheet contacts the sheet guides 41 and 41 as described above, transfer of such heat to the heat conductive holder (e.g., the heat dissipating part 10) is inhibited. Thus, temperature rise of the heat conductive holder is suppressed, and the heat is preferably transferred from the protector (e.g., the protection glass 7) to the heat conductive holder. Then, the temperature rise of the protector is suppressed.

Aspect 13

The image forming apparatus according to Aspect 11 further includes a guide heat conductor (e.g., the third heat conductive sheet 43 and the fourth heat conductive sheet 44) disposed in tight contact with the sheet guide (e.g., the sheet guides 41 and 42) and the heat conductive holder (e.g., the heat dissipating part 10) to transfer the heat from the sheet guide to the heat conductive holder.

According to this aspect, as described above, the heat of the sheet guides 41 and 42 can be transferred via the guide heat conductor (i.e., a heat conductive part) to the conductive holder (e.g., the heat dissipating part 10), thereby suppressing the temperature rise of the sheet guide. Then, the sheet guides 41 and 42 can preferably absorb heat of the recording medium (e.g., the transfer sheet, and the recording medium is cooled with the sheet guides 41 and 42. Thus, the amount of heat transferred from the recording medium to the protection glass 7 can be reduced, and the temperature rise of the protector is inhibited.

Aspect 14

In any one of Aspects 11 to 13, the sheet guide is disposed on each of the upstream side and the downstream side of the protector (e.g., the protection glass 7) in the direction of conveyance of the recording medium (the transfer sheet P).

As described above, this aspect is advantageous in inhibiting both of the recording medium (the transfer sheet P) advancing to the image detection position where the image detector (e.g., the image sensor 1) detects the image and the recording medium (the transfer sheet P) departing from the image detection position from contacting the protector (e.g., the protection glass 7).

Aspect 15

In any one of Aspects 1 to 14, the heat conductive holder is made of metal.

According to this aspect, the heat of the protector (e.g., the protection glass 7) is preferably transferred to the heat conductive holder (e.g., the heat dissipating part 10) to be dissipated.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. An image forming apparatus comprising:

a conveyance path to convey a recording medium;

an image forming device to form an image on the recording medium;

a heating device to heat the recording medium;

an image detector disposed downstream from the heating device in a direction of conveyance of the recording medium, the image detector to detect the image on the recording medium;

a protector projecting beyond the image detector toward the conveyance path, the protector to protect the image detector; and a heat conductive holder to hold the protector.

2. The image forming apparatus according to claim 1, further comprising a heat dissipating assist coupled to the heat conductive holder, to assist the heat conductive holder in heat dissipation.

3. The image forming apparatus according to claim 2, wherein the heat dissipating assist is made of aluminum.

4. The image forming apparatus according to claim 2, wherein the heat dissipating assist includes a plurality of fins.

5. The image forming apparatus according to claim 2, wherein the image detector includes a board to generate heat, and wherein the heat dissipating assist is coupled to the board of the image detector to receive heat from the board and dissipate the heat.

6. The image forming apparatus according to claim 5, wherein the heat conductive holder includes a detector support to support the image detector, the detector support including a positioning portion to determine a position of the image detector, and wherein the heat dissipating assist includes a spring to press the image detector to the positioning portion.

7. The image forming apparatus according to claim 5, further comprising a board heat conductor disposed in tight contact with the board of the image detector and the heat dissipating assist to transfer the heat of the board to the heat dissipating assist.

8. The image forming apparatus according to claim 7, wherein the board heat conductor is insulative.

9. The image forming apparatus according to claim 2, further comprising a holder heat conductor disposed in tight contact with the heat conductive holder and the heat dissipating assist to transfer the heat of the heat conductive holder to the heat dissipating assist.

10. The image forming apparatus according to claim 9, further comprising a slide assist sheet attached to the holder heat conductor, wherein the holder heat conductor is attached to one of the heat dissipating assist and the heat conductive holder, wherein the holder heat conductor is to contact, via the slide assist sheet, the other of the heat dissipating assist and the heat conductive holder, and wherein a friction coefficient between the slide assist sheet and the other of the heat dissipating assist and the heat conductive holder is lower than a friction coefficient between the holder heat conductor and the other of the heat dissipating assist and the heat conductive holder.

11. The image forming apparatus according to claim 2, further comprising a cooling device to cool the heat dissipating assist.

12. The image forming apparatus according to claim 11, further comprising a controller to control the cooling device.

13. The image forming apparatus according to claim 1, further comprising at least one sheet guide disposed adjacent to an image detection position of the image detector and projecting beyond the protector toward the conveyance path, the at least one sheet guide including an attached portion attached to the heat conductive holder, wherein the at least one sheet guide is to guide the recording medium not to contact the protector.

14. The image forming apparatus according to claim 13, wherein a remaining portion of the at least one sheet guide except the attached portion is contactless with the heat conductive holder.

15. The image forming apparatus according to claim 13, further comprising a guide heat conductor disposed in tight contact with the at least one sheet guide and the heat conductive holder, to transfer the heat from the at least one sheet guide to the heat conductive holder.

16. The image forming apparatus according to claim 13, wherein the at least one sheet guide includes an upstream sheet guide and a downstream sheet guide respectively disposed upstream and downstream from the protector in the direction of conveyance of the recording medium.

17. The image forming apparatus according to claim 1, wherein the heat conductive holder is made of metal.

* * * * *